United States Patent [19]

Hewlett

[11] Patent Number: 4,721,408

[45] Date of Patent: Jan. 26, 1988

[54] WATER DISTRIBUTION SYSTEM

[76] Inventor: Robert F. Hewlett, P.O. Box 270938, Tampa, Fla. 33688

[21] Appl. No.: 921,389

[22] Filed: Oct. 22, 1986

[51] Int. Cl.[4] ..... E02B 13/00

[52] U.S. Cl. ..... 405/48; 405/36; 405/40; 405/51

[58] Field of Search ..... 405/36–49, 405/51; 210/170, 340, 498; 239/520, 523, 524, 533.13, 542, 547; 47/48.5

[56] References Cited

U.S. PATENT DOCUMENTS

| | | | |
|---|---|---|---|
| 953,080 | 3/1910 | Wiggins | 405/48 |
| 1,058,582 | 4/1913 | Harris | 405/48 |
| 1,604,189 | 10/1926 | Nelson | 405/39 X |
| 2,536,196 | 1/1951 | MacLeod | 405/51 X |
| 3,080,124 | 3/1963 | Rathmann | 405/45 X |
| 3,966,233 | 6/1976 | Diggs | 405/48 |
| 4,319,998 | 3/1982 | Anderson | 210/170 X |
| 4,402,631 | 9/1983 | Rosenthal | 405/48 |
| 4,522,533 | 6/1985 | Campbell et al. | 405/40 X |
| 4,582,605 | 4/1986 | Rea et al. | 210/498 X |
| 4,592,839 | 6/1986 | Rosenberg | 210/498 X |

*Primary Examiner*—Nancy J. Stodola
*Attorney, Agent, or Firm*—Pettis & McDonald

[57] ABSTRACT

An improved water distribution system characterized by a construction including an irrifluent pipe disposed below the soil surface for dispersing water or treated waste water at a controlled rate. The irrifluent pipe includes an inner fluid conduit having apertures formed therethrough and an outer cover mounted in partially surrounding relation to the inner conduit and overlying the apertures. The outer cover is attached to the inner fluid conduit in spaced apart relation thereto so that the dispersed fluid slowly seeps into the ground.

9 Claims, 5 Drawing Figures

WATER DISTRIBUTION SYSTEM

BACKGROUND OF THE INVENTION

1. Field of the Invention

The present invention relates to an improved water distribution system of the type including a source of water, at least one main delivery conduit and means for passing water form the source through the main delivery conduit. The improvement comprises at least one irrifluent pipe disposed in fluid communicating relation to the main delivery conduit and buried beneath the soil surface into which the fluid is to be delivered. By virtue of the unique construction of the irrifluent pipe and the use of control filter means for connecting the irrifluent pipe to the main delivery conduit, water, including treated waste water, may be applied to the soil subsurfaces in an extremely efficient manner.

2. Description of the Prior Art

The relative desirability of irrigating an area by underground water distribution, as opposed to above ground spraying, has long been recognized. A most obvious benefit from subsurface irrigation is substantial elimination of water loss by evaporation. Furthermore, subsurface distribution clearly places the water adjacent plant roots where it is most beneficial.

It is not surprising, then, that prior art patent literature discloses and teaches numerous devices for underground irrigation systems. On exemplar device is taught in U.S. Pat. No. 3,946,762 to Green. That patent teaches the use of a subsurface, perforate conduit that is covered by a fine mesh fabric sheath so that fluid under slight to moderate pressure will flow through the apertures and fluid distribution will be uniform throughout the length of the fabric sheath placed therearound. While the utility of the system of this invention cannot be denied, it also cannot be denied that after any substantial period of subsurface use, the fabric sheath is quite likely to become substantially impregnated with soil particles, thereby reducing if not entirely eliminating its efficiency.

A similar, but much older, soil moistening apparatus is disclosed in U.S. Pat. No. 2,798,768 to Babin. This patent discloses an apertured conduit wherein the apertures are covered by porous inserts which permit the water flowing through the conduit to seep outwardly therefrom. U.S. Pat. No. 3,899,135 to O'Brian discloses a water emitter utilizing a sleeve which fits around a slotted tube wherein the sleeve is movable relative to the slits to regulate the amount the slit will open in response to internal fluid pressure. Accordingly, the sleeve, in cooperation with the slits, determines the fluid flow rates for irrigation purposes.

Still other underground irrigating systems are disclosed in U.S. Pat. Nos. 444,564 to Copeland; 728,088 to Dillon; 3,046,747 to Timpe; 4,117,685 to Skaife; and 4,235,561 to Peterson. The first three of these patents basically comprise apertured conduits which are buried below the soil's surface. The patent to Skaife teaches a total underground irrigation system wherein apertures in the delivery pipe are protected from clogging by the placement of a screen around the delivery conduit. The Peterson patent discloses a porous, or semi-permeable, pipe through which the water flows and from which the water seeps due to its porous nature.

Even a cursory review of the prior art patent literature confirms that a recurring problem with underground irrigation systems is that the water delivery apertures which are invariably present in some fashion tend to become clogged unless relatively high levels of water pressure are maintained at all times. Obviously, it is not always necessary to apply water, so one may not always maintain the necessary high water pressures. As a result, current subsurface irrigation systems are frequently subject to failure as by clogging.

However, one must not limit his consideration of the prior art to irrigation systems exclusively. As the United States becomes more populous, two problems associated with water conservation become more difficult to resolve everyday. First is the problem of returning water to natural underground aquifers. The second involves some suitable means of handling treated waste water. Current waste water treatment often calls for aeration of the effluent with attendent undesirable results. Not only are large quantities of water lost by evaporation, but also unpleasant odors may be released into the atmosphere. Of course, most municipalities will not permit the release of waste water into the environment unless it has been appropriately cleaned and treated, most often including the addition of large quantities of chemicals such as, for example, chlorine into the water.

It is therefore apparent that there is a great need in the art not only for an improved subsurface irrigation system, but also that there is an extreme need for alternative means of dispersing treated waste waters. In terms of subsurface irrigation, the system must not be subject to clogging, must not require high water pressures for efficient operation, and must be capable of maintaining its integrity and operability even when long periods of no water flow are experienced. Such a subsurface system, used for the dispersion of treated waste water must have these same characteristics, and must also include means to prevent interior clogging of the water distribution system.

SUMMARY OF THE INVENTION

The present invention relates to an improved water distribution system and is primarily intended for subsurface application of water to the soil. The system includes a source of water, at least one main delivery conduit for the water, and means for passing the water from its source through the main delivery conduit. The improvement comprises at least one irrifluent pipe disposed in fluid communicating relation to the main delivery conduit whereby water is actually applied to the ground. As indicated above, the irrifluent pipe is preferably disposed beneath the surface of the ground, but the scope of the invention is not limited thereto. It is also to be noted that while the word "water" will be utilized in describing the fluid distribution, the term is meant to include not only potable water but also virtually any other form of irrigating fluid such as, for example, river water, lake water, waste water, or even such waters having chemical additives therein for the purpose of providing nutrients to the soil and plants growing therein.

In its preferred embodiment, both the main delivery conduit and the irrifluent pipe may be formed from a plastic material such as, for example, polyvinylchloride (PVC). The improved water distribution system of this invention is not limited to any particular size, but is primarily intended to be operated at relatively low water pressure such as in the range of 5–15 psi. Specific sizes of structural elements will be set forth in the detailed description presented hereinafter for illustrative purposes only.

Because the improved water distribution system of this invention is primarily intended for use with the irrifluent pipes disposed below ground, the improved system further comprises control filter means disposed in fluid communicating, interconnecting relation between the main delivery conduit and the irrifluent pipes. As is described in greater detail below, the control filter means comprises both a filter disk mounted downstream of the main delivery conduit for the purpose of preventing the passage of extraneous matter into the irrifluent pipe, and also includes a distribution disk mounted downstream of the filter disk whereby rate of flow into each irrifluent pipe may be controlled.

The construction of the irrifluent pipe is unique in that it not only provides for an extremely gentle and efficient distribution of water along its entire length, which may be as much as 50 feet or more, but also virtually eliminates clogging of the distribution system even when no water flow is present. Briefly stated, the irrifluent pipe comprises a circular inner fluid conduit having a plurality of apertures formed through its wall in regular, spaced apart relation to each other along the length of the inner fluid conduit. An outer cover is fixedly attached to the inner fluid conduit by a plurality of stop means, one of said plurality being on opposite sides of each one of the apertures, and the outer cover being slightly spaced apart from the inner fluid conduit by the stop means. According to this preferred construction, the outer cover is formed by a diametrical cut along the length of a PVC pipe which is the same size as the apertured inner fluid conduit. Accordingly, in cross section, the outer cover is substantially equivalent to one half the cross section of the inner fluid conduit. The stop means may comprise a waterproof adhesive whereby water exiting from one of the inner conduit apertures may not flow past either of the stop means without first exiting the space between the outer cover and the inner fluid conduit. In the preferred installation of this system, the irrifluent pipe is placed below the ground such that the outer cover means is upward, or closest to the surface of the soil. Accordingly, as water exits the apertures formed through the inner conduit, it will seep outwardly and downwardly from opposing slits defined by the space between the outer cover and the inner conduit along the sides of the irrifluent pipe. The presence of the stop means which are regularly interposed between each of the inner fluid conduit apertures insures relatively constant fluid pressure throughout the length of the irrifluent pipe.

It can therefore be seen that the improved water distribution system of this invention provides not only a simple and efficient water distribution system, but also an extremely reliable means for delivering irrigation water or dispersing treated wastewater back into the ground. Because the water is distributed below ground, there are vitrually no losses due to evaporation. Because the water is distributed at relatively low flow rates, quite large quantities of water may be distributed over long periods of time without saturating the surrounding soil. It can also be appreciated that when the improved system of this invention is used for distributing treated waste water, there are no visible indications that the installation site is being used for such purposes, and there is virtually no chance of creating objectionable odors in the process. It can also be appreciated that utilization of the improved water distribution system of this invention will permit waste water disposal in land areas that are also used for other purposes such as, for example, parks, athletic fields, groves, highway rights of way, and even greenbelt areas around office buildings or apartment complexes.

The invention accordingly comprises the features of construction, combination of elements, and arrangement of parts which will exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
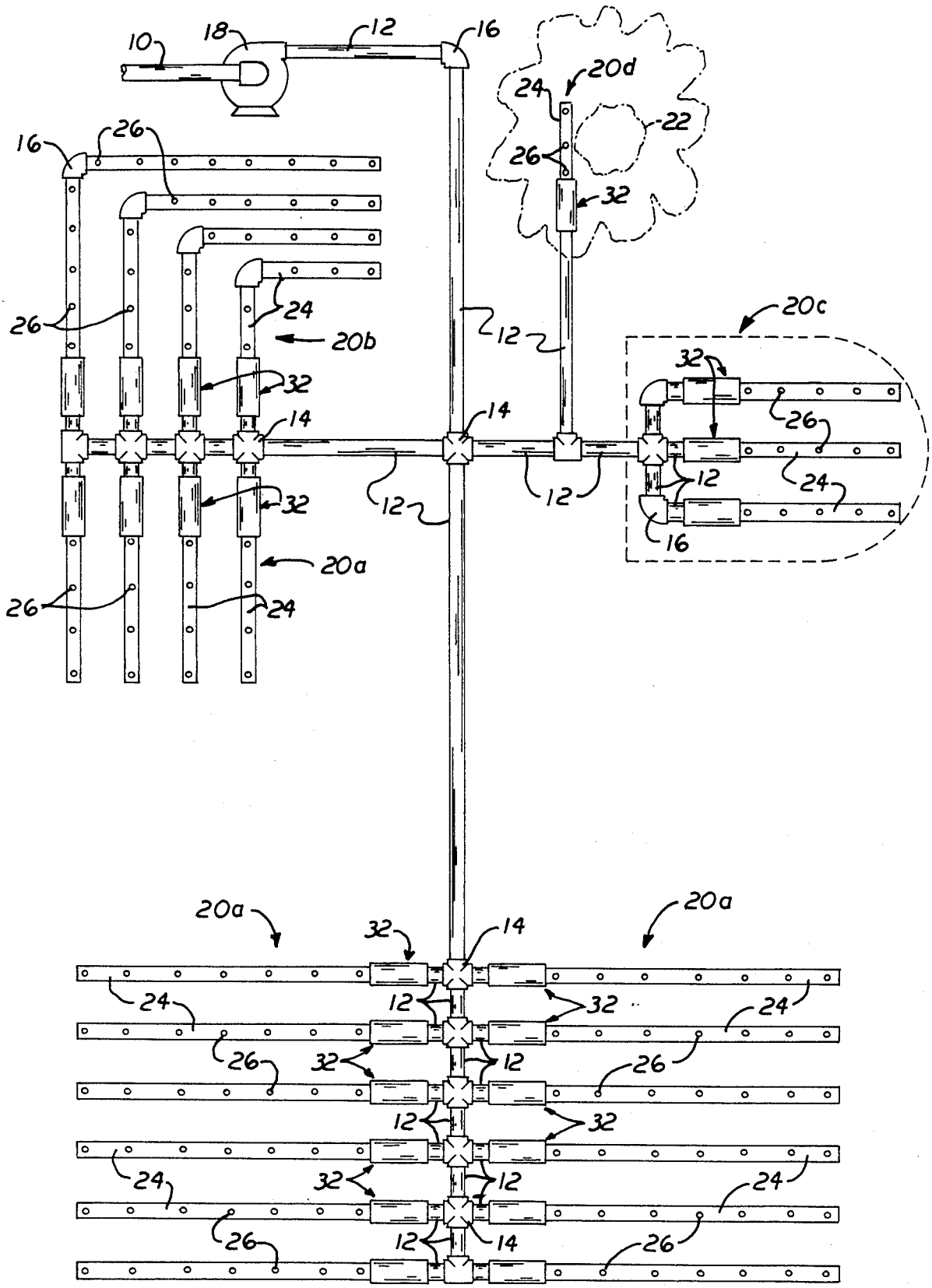
FIG. 1 is a schematic plan view of a typical installation of the improved water distribution system of this invention with the outer cover removed from the irrifluent pipes for the sake of clarity.

As indicated above, the view of FIG. 1 presents a schematic, plan illustration of what might be termed a typical improved water distribution system of this invention. It is to be noted that the drawing figures are not to scale so that structural details may be better illustrated. The improved water distribution system includes a source of water such as source pipe 10. The distribution system further includes at least one main delivery conduit 12, and as can be seen in the view of FIG. 1, this installation includes a plurality of such main delivery conduits 12. Of course, appropriate connectors 14 and elbows 16 are also provided within the installation. FIG. 1 also illustrates a means for passing water from source pipe 10 into main delivery conduit 12 comprising a pump 18.

According to standard installation techniques for water irrigation/distribution systems, it is to be understood that substantial portions of source pipe 10 as well as main delivery conduit 12 and its associated connectors 14 and elbow 16 could be disposed below the surface of the soil. It is also to be understood that these elements may be formed from any suitable material, but PVC conduit and connector elements are preferred. It is further to be understood that the scope of the invention is not limited to any particular size for source pipe 10 or main delivery conduits 12, and specific diameters for these elements are chosen with regard to the area to be irrigated and the rate at which the water is to be applied. Of course, as previously indicated above, the improved water distribution system of this invention is preferrably operated as a low pressure distribution system with the pressure of water being delivered normally falling within the range of about 5–15 psi.

The improvement of this water distribution system comprises an irrifluent pipe generally indicated as 20 and disposed in fluid communicating relation to main delivery conduit 12. In the schematic representation of FIG. 1, alternative installations of irrifluent pipe 20 are indicated by the addition of a letter to the general reference numeral. Irrifluent pipe 20*a* represents a typical straight-branched installation, while irrifluent pipe 20*b* illustrates an installation having a right bend. Irrifluent pipe 20*c* depicts an installation which might be used for providing water to a remote bed or "island," while irrifluent pipe 20*d* depicts the use of a single irrifluent pipe for providing water to a tree 22 (indicated in phantom).

Figure 2:
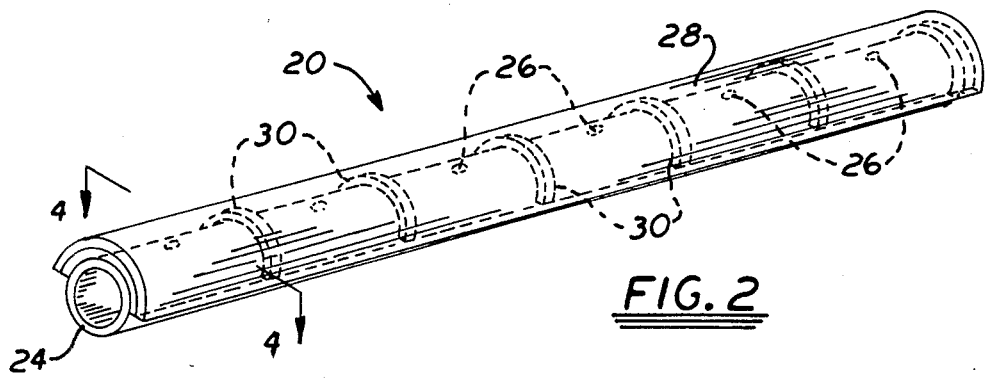
FIG. 2 is a perspective view of an irrifluent pipe segment.
Figure 3:
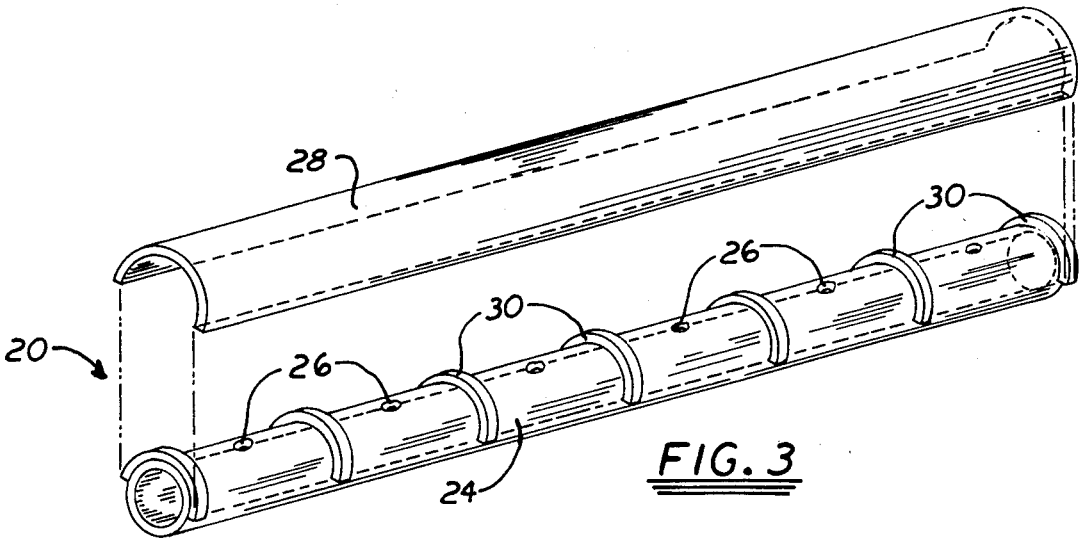
FIG. 3 is an exploded view of the irrifluent pipe segment shown in FIG. 2.
Figure 4:
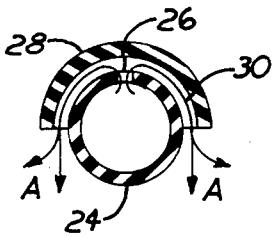
FIG. 4 is a sectional view taken along line 4—4 of FIG. 2.

A more detailed view of a typical irrifluent pipe 20 is presented in the views of FIGS. 2 and 3. As shown therein, irrifluent pipe 20 comprises and inner fluid conduit 24 which, dependent upon its length, will have a plurality of apertures 26 formed through its wall, and an outer cover 28 attached in spaced apart relation to inner fluid conduit 24 such that outer cover 28 is disposed in overlying relation to apertures 26. As perhaps best seen in the view of FIG. 3, outer cover 28 is attached to inner fluid conduit 24 by a plurality of water stop means 30. In this preferred embodiment, water stop means 30 comprise a waterproof adhesive. As clearly seen in FIGS. 2 and 3, each of the water stop means 30 is disposed on opposite sides of each aperture 26. By virtue of this construction, and as best seen in the sectional view of FIG. 4, water passing through inner fluid conduit 24 will be expelled through aperture 26. Because of the blocking effect of water stop means 30, the water will fill the space defined between inner fluid conduit 24 and outer cover 28 and will then be dispersed along the longitudinal dimension thereof as indicated by directional arrows A in the view of FIG. 4.

It is to be remembered that in the schematic representation of FIG. 1, each of the outer covers 28 has been omitted for the sake of clarity. In the final installation such as is depicted in FIG. 1, outer covers 28 would be included. In addition, the irrifluent pipes 20 are positioned so that the outer covers 28 are upward, or relatively oriented toward the soil surface in which pipes 20 are buried.

Figure 5:
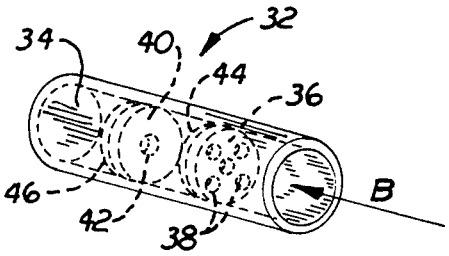
FIG. 5 is a perspective view of the control filter means with interior structural detail shown in phantom.

Referring next to the view of FIG. 5, the improved water distribution system of this invention further comprises a plurality of control filter means generally indicated as 32 whereby irrifluent pipe means 20 are attached to main delivery conduit 12 in fluid communicating relation thereto. Each of the control filter means 32 comprises a water conduit 34 having an inside diameter that is substantially equal to the outside diameter of main delivery conduit 12 and irrifluent pipe 20. A filter disk 36 is mounted within water conduit 34 downstream of the main delivery conduit 12 so that water flowing into the control filter means 32 from main delivery conduit 12 as indicated by directional arrow B first impinges upon the filter disk 36. A plurality of filter apertures 38 are formed through filter disk 36 for the purpose of removing particulate matter from the flowing fluid stream without significantly affecting the rate of flow. It is preferred that the diameter of each of the filter apertures 26 formed through inner fluid conduit 24. Control filter means 32 further comprises a distribution disk 40 mounted within water conduit 34 down stream of filter disk 36. A central control aperture 42 is formed through distribution disk 40 whereby the rate of water flow into irrifluent pipe 20 is limited. Thus, by varying distribution disk 40 to include a central control aperture 42 of different dimensions, different flow rates may be obtained.

Still referring to the view of FIG. 5, it can be seen that a filter disc stop means comprising an annular filter 44 may be formed on the inside of water conduit 34 so as to maintain filter disk 36 in spaced apart relation from distribution disk 40. A similar annular distribution ring 46 may also be provided downstream of distribution disk 40, but such a structure is not preferred, for that would make replacement of distribution disk 40 quite difficult if not impossible. Rather, distribution disk 40 is preferably retained in place by the end of inner fluid conduit 24 that is inserted into water conduit 34.

For purposes of illustration only, and without in any way limiting the scope of the present invention, the "typical" installation depicted in FIG. 1 may now be referred to for relative size and spatial considerations for the various structural elements of the invention. The inside diameter of source pipe 10 is chosen with regard to the capacity of pump 18 and the total volume of water to be distributed. In this installation, both main delivery conduits 12 and inner fluid conduits 24 are formed from one-half inch PVC. Accordingly, the outer covers 28 are also formed from one-half inch PVC. These conduits are preferably formed from PVC because that is a relatively inert material and is generally accepted for irrigation and water distribution purposes. The apertures 26 are formed along inner fluid conduit 24 on 12 inch centers. While the length of any particular irrifluent pipe 20 is determined by its end use application, pipes 20 may be in sections as short as one foot or as long as 50 feet. Of course, it is to be understood that in the final, end-use installation, the distal end of each irrifluent pipe 20 would be capped.

Just as the apertures 26 are formed on twelve inch centers, so are the water stop means 30 similarly spaced so that the distance from an individual water stop means 30 to an adjacent aperture 26 is approximately six inches. For irrifluent pipe 20 of about 50 feet in length, the central control apertures 42 formed through distribution disk 40 will have a diameter of about 5/64 inches. The filter disk 36 will preferably include five filter apertures 38 of the same size, and the apertures 26 formed through inner fluid conduit 24 will have a dimension of about 3/32 inches. Dependent upon the rate of flow desired throughout the system, the water pressure within main delivery conduit 12 will be maintained at from about 5–15 psi. All interconnections between main delivery conduit 12 and connectors 14 and elbows 16 as well as the interconnection of the control filter means 32 are made according to standard, state-of-the-art technology and procedures.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is;

1. An improved water distribution system of the type including a source of water, at least one main delivery conduit and means for passing water from the source through the main delivery conduit, wherein the improvement comprises at least one irrifluent pipe disposed in fluid communicating relation to the main delivery conduit by control filter means attached in interconnecting relation between said irrifluent pipe and the main delivery conduit, said irrifluent pipe comprising an inner fluid conduit and an outer cover fixedly attached in spaced apart relation thereto, said inner fluid conduit comprising at least one aperture formed therethrough and said outer cover overlying said aperture; said outer cover being fixedly attached to said inner fluid conduit by a plurality of water stop means, one of said plurality being on opposite sides of said aperture, an end of said irrifluent pipe remote from said control filter means being capped.

2. An improved water distribution system as in claim 1 wherein said control filter means comprises a water conduit having an inside diameter that is substnatially equal to the outside diameter of both the main delivery conduit and the irrifluent pipe, a filter disk mounted within said water conduit downstream of the main delivery conduit, and a distribution disk mounted within said water conduit downstream of said filter disk and upstream of said irrifluent pipe.

3. An improved water distribution system as in claim 2 wherein said distribution disk includes a central control aperture formed therethrough, whereby the rate of water flow into said irrifluent pipe is limited.

4. An improved water distribution system as in claim 3 wherein said filter disk includes a plurality of filter apertures formed therethrough.

5. An improved water distribution system as in claim 2 wherein said control filter means further comprises a filter disk stop means formed on the interior of said water conduit between said filter disk and said distribution disk, whereby said disks are maintained in a spaced apart relation to each other.

6. An improved water distribution system as in claim 1 wherein said outer cover defines a cross section that is substantially equivalent to one half the cross section of said inner fluid conduit.

7. An improved water distribution system as in claim 6 wherein said outer cover defines a semicircular cross section.

8. An improved water distribution system as in claim 1 wherein said water stop means comprises a waterproof adhesive, whereby water exiting from said aperture may not flow past one of said stop means without first exiting said space between said outer cover and said inner fluid conduit.

9. An improved water distribution system as in claim 1 wherein said irrifluent pipe is disposed below ground.

* * * * *